US005775684A

United States Patent [19]

Jackson et al.

[11] Patent Number: 5,775,684

[45] Date of Patent: Jul. 7, 1998

[54] APPARATUS FOR FEEDING DISTINCT FEED STOCK AND MAINTAINING THE ALIGNMENT OF PRINTABLE STOCK IN A ROLLER DRIVEN TRAY INFORMATION TRANSFER DEVICE

[75] Inventors: Richard C. Jackson, San Jose; John Avery Howard; Christopher O. Lada, both of Palo Alto; Donald S. Minami, Monte Sereno, all of Calif.; Lan Hao-Jui, Taipei, Taiwan; Tsai Cheng-Liang, Fu-Chien Province, China

[73] Assignee: Apple Computer, Inc., Cupertino, Calif.

[21] Appl. No.: 545,895

[22] Filed: Oct. 20, 1995

[51] Int. Cl.[6] ..... B65H 3/44

[52] U.S. Cl. ..... 271/9.07; 271/9.12; 271/9.13; 271/110; 271/118; 271/119; 271/245

[58] Field of Search ..... 271/9.01, 9.07, 271/9.12, 9.13, 9.03, 241, 245, 246, 117, 118, 119, 110

[56] References Cited

U.S. PATENT DOCUMENTS 5,120,040 6/1992 Worley ..... 271/9.07

5,391,009 2/1995 Stodder ..... 271/9.13 X

FOREIGN PATENT DOCUMENTS 38644 1/1991 Japan ..... 271/9.01

5124739 5/1993 Japan ..... 271/9.01

*Primary Examiner*—David H. Bollinger

*Attorney, Agent, or Firm*—Blakely, Sokoloff, Taylor & Zafman

[57] ABSTRACT

Apparatus for feeding distinct feed stock through a roller driven tray device to an information transfer device (i.e., scanning, facsimile, printing, copying) or a multipurpose information transfer device for processing feed stock, the roller driven tray device comprising a first tray and a second tray each tray capable of holding an item of feed stock for processing through the same port of an information transfer device from either tray without manual intervention. Also, an apparatus for maintaining alignment of feed stock in a roller driven tray device comprising a cam radially coupled to the first end of the roller shaft, a cam follower seated on the cam, a cam shaft with one end coupled to the cam follower and a second end slidably coupled to the tray housing, and a cantilever finger crank coupled to the cam shaft, and having a first position to not impede the path of the feed stock and a second position against the feed stock.

19 Claims, 11 Drawing Sheets

APPARATUS FOR FEEDING DISTINCT FEED STOCK AND MAINTAINING THE ALIGNMENT OF PRINTABLE STOCK IN A ROLLER DRIVEN TRAY INFORMATION TRANSFER DEVICE

FIELD OF THE INVENTION

The invention relates generally to electronic information transfer devices, i.e., scanning, facsimile sending and receiving, copying, and printing devices, and more particularly to the mechanisms for, feeding feed stock into these devices.

BACKGROUND OF THE INVENTION

Information transfer devices include scanning devices for electronically or optically sensing a recorded image for later modification, facsimile devices for electronically sending or receiving an image over a voice frequency circuit, printing devices for producing a recorded image, and copying devices for reproducing a recorded image. Collectively, these devices represent a considerable cost and occupy considerable physical space on a desk or in an office. Thus, effort has been focused at information transfer devices that can accomplish multiple tasks (i.e., scanning, faxing, copying, and/or printing) at a lower cost and smaller space requirement.

Individually, each of the described information transfer devices generally contains its own or is directly connected to a printing device. A scanning device is electronically linked to a printing device to reproduce a scanned image, a facsimile device has its own or is electronically linked to a printing device to reproduce a received image, and a copying device has its own printing device to reproduce a copied image. One way that information transfer devices combine printing, faxing, copying, and scanning is by using a scan head mechanism to receive an image and then processing the image to an electronic image (scanning function), to a separate location over a voice frequency circuit (facsimile function), or to a reproduction with the aid of a printing device (copying function). The printing device may also be used to print electronically generated documents, e.g., computer files.

Typical printing devices include dot matrix, ink, and laser printers. Dot matrix printers generate characters on a page with a matrix of dots and the aid of an inked ribbon. Ink printers utilize a motor to drive a wet ink marker or pen across a page to generate characters on the page. The Apple Stylewriter Inkjet printer series, for example, utilizes a motor to drive a carriage containing an ink cartridge, back and forth along the width of a sheet of paper according to electronically received information, e.g., from a computer. The other commonly used printing device, the laser printer, utilizes a low-powered laser to produce image forming charges on the photoconductive surface of a drum. Dry powder is then allowed to adhere to the charged areas, and the image of the drum is transferred to paper, and the dry powder is fused to the paper with heat.

The different printing devices utilize various methods to position a sheet of paper for printing. Some printing devices operate by "tractor feed", wherein continuous feed paper is fed through the printing device by way of sprockets. Typically, at least one sprocket is located on each side of the printing device and axially aligned with and rotates with an identical sprocket on the other side of the printing device. The sprockets are positioned to correspond with openings in the continuous feed paper. The continuous feed paper is aligned to travel through the printer squarely by positioning the complimentary openings on either side of the continuous paper with complimentary projections in the sprockets.

A method to position separate sheets of paper for printing is by aligning the paper squarely in a paper tray or a cassette and using the tangential force imparted by a roller to move a single sheet in position for copying or printing. According to this method, a rotatable roller shaft extends the width of the sheet-feed opening of a printing device. A roller is attached to all or part of the roller shaft. Individual sheets of paper are aligned in a paper tray or a cassette to travel through the printing device squarely through the use of paper guides that correspond to the width and/or length of the individual sheets of paper to be printed. An individual sheet of paper is selected for printing by positioning the sheet in contact with the roller and rotating the roller in a direction to move the paper through the printing device. The individual sheet of paper is positioned in contact with the roller either by force (i.e., spring tension) or the movement of the paper tray or cassette in a direction that will achieve contact with the roller.

The Apple Stylewriter printer series utilizes the paper tray mechanism of positioning individual sheets of paper for printing. The paper tray of the Stylewriter series can accommodate approximately 100 sheets of paper. The paper in the paper tray is aligned according to the feed size (i.e., 8.5 in.×11 in. paper, 4.5 in.×10.4 in. envelope, etc.) by the use of adjustable paper guides that square the paper in true within the tray. The Stylewriter series use a roller in the shape of the letter "D" i.e., a "D-roller", attached to the roller shaft. The roller shaft is connected to a motor which rotates the roller shaft. Paper stock rests in an approximately vertical paper tray relative to the printing device. To select a sheet of paper from the paper tray, the paper tray pivots forward to place a sheet of paper in the paper tray in contact with the D-roller. The D-roller rotates one revolution and forces (pushes) the paper tangentially forward into the printing mechanism. The paper tray then pivots back to its original position and any other paper in the paper tray is not in contact with the D-roller.

The roller-driven feed mechanisms use adjustable paper guides to square the paper in true within the tray or cassette so that the paper feeds through the printing device squarely and the printing is formatted correctly on the paper. Additional paper in the paper tray or cassette of the roller-driven feed mechanisms described above encounter problems associated with fanning and scew. Fanning occurs when the paper remaining in the paper tray or cassette spreads or fans toward the printing mechanism causing more than the contemplated single sheet of paper to be retrieved by the roller and sent through the printing mechanism. Fanning is a particular problem with those printing devices like the Apple Stylewriter series printers that pivot the paper tray to establish contact between the paper tray and the single sheet of paper. As the paper tray pivots forward and the D-roller selects sheet after sheet of paper, the sheets remaining in the paper tray slowly fan forward and eventually come in contact with or are transported by the D-roller into the printing device.

An attempt to alleviate the fanning problem is to place a stopper at the feed port to the printing device. Some printing devices, like the Apple Stylewriter series printers, attach a stopper to the D-roller shaft. After the D-roller rotates and selects a sheet of paper, the stopper pushes against a corner of the remaining paper in the paper tray to support the paper and keep the paper taut.

Scew occurs when the paper remaining in the paper tray is no longer in true, but leans to one side or the other. This is a particular problem for printing devices with upright paper trays or cassettes, particularly those devices attempting to solve the fanning problem with a stopper. The stopper mechanism design is limited to pushing against only a corner of the paper in the paper tray. The other corner is not supported by a stopper. Consequently, the unsupported corner can drift slightly or scew. When a scewed sheet of paper is picked up by the roller and moved through the printing device, the paper can become stuck or jammed in the printing device or the printing is not formatted correctly on the paper.

The different printing devices offer different levels of functionality with respect to the feed stock that can be fed to the printing device at any one time. Tractor feed devices are limited to a single feed stock of continuous feed paper at any one time. To change the feed stock, the continuous feed paper must be changed by aligning the complimentary openings in the paper with the corresponding sprockets. Similarly, most inexpensive tray-fed printing devices only offer the ability to accept paper from a single tray or cassette through a single feed port. In order to change the feed stock, the stock in the paper tray or cassette must be replaced with the new stock. Some of these printing devices also offer a feature that allows the user to intervene in the transfer process and manually override the paper tray or cassette to feed a sheet of paper through the printing device. In addition to requiring manual intervention, these printing devices similarly limit the feed stock to a single piece of printable matter (i.e., a single sheet of paper, or a single envelope).

Significantly more expensive printing devices offer the functionality of multiple paper trays or cassettes. In addition to being more expensive, the multiple tray or cassette printing devices translate into considerable additional physical space to accommodate additional trays or cassettes and additional feed ports, and, in some cases, multiple motors and multiple drive trains to move separate paper through entirely separate paper paths.

Many of the other information transfer devices (i.e., copying devices, facsimile devices, and scanning devices) utilize the same document feed devices as printing devices. For example, many copying devices, facsimile devices, and scanning devices use a roller driven tray mechanism to feed documents into the machine. The problems associated with the feeders to the printing devices are likewise evident with other information transfer devices.

There exists a need for an inexpensive information transfer feed device that can provide the functionality of multiple paper trays that can handle different feed stocks in varying quantitites without manual intervention to override the automatic operation of the machine. There also exists a need for mechanisms that eliminate fanning and scew in the roller-driven feed transfer mechanisms. Finally, there is a need for a feed device that can accommodate the functionality of multipurpose information transfer devices with small physical space and cost requirements.

SUMMARY AND OBJECTS OF THE INVENTION

The invention incorporates multiple tray functionality into a roller driven tray information transfer device without the additional space or expense requirements associated with multi-tray transfer devices. The invention accomplishes the functionality of multi-tray transfer devices by an apparatus combining a first and second tray into a single apparatus that automatically (i.e., without manual feed intervention) feeds a single feed port of a transfer device from either tray. Different feed stocks in various quantities can be placed in the first and second trays. According to the invention, if feed stock is in the second (forward) tray, the roller automatically chooses an item of feed stock over feed stock in the first (back) tray and directs a sheet of paper from the second tray to the information transfer device. If the second tray is empty but the first (back) tray has feed stock, the roller chooses an item of feed stock from the first (back) tray and directs that sheet to the transfer device. By providing an apparatus whereby all stock enter through a single feed port, the invention can utilize the same roller and the same document path for an information transfer device that offers multiple feed stock functionality. Thus, the invention provides the functionality of multiple trays and automatic feed from either tray in a compact physical space at an inexpensive cost.

The invention contemplates uses with any information transfer device, i.e., scanning, facsimile sending and receiving, copying, and printing. The invention further contemplates uses with multipurpose information devices. The multi-tray functionality of the invention is capable of supporting distinct transfer devices through the same feed port. For example, documents in the second (forward) tray can be directed to a scan head mechanism to receive an image and then process the image to an electronic image (scanning function), to a separate location over a voice frequency circuit (facsimile function), or to a reproduction with the aid of a printing device (copying function), while documents in the first (back) tray can be directed to the printing device to reproduce a received image or to print electronically generated documents, e.g., computer files.

The invention further provides an apparatus for maintaining alignment of feed stock in a roller driven tray information transfer device by attaching a cantilever finger crank to the roller by way of a cam shaft, cam follower, and cam. The cantilever finger crank presses against the unsupported corner of the remaining feed stock in the tray or trays to support the stock and keep the stock taut. The cam is attached directly to the roller, so that when the roller rotates to retrieve an item of feed stock (i.e., a sheet of paper), the cam follower directs the cam shaft to move the cantilever finger crank to a first position to not impede the path of the selected feed stock into the information transfer device. After the selected item of feed stock is sent to the information transfer device, the cam moves the cam follower to direct the cam shaft to move the cantilever finger crank to a second position to hold the remaining feed stock in the tray taut. The invention eliminates fanning and scew of the stock in the tray and the problems associated with fanning and scew (i.e., multiple sheets of paper through the information transfer device, crooked image on the paper, etc.) in roller-driven tray information transfer devices. With respect to the inventive multi-tray apparatus, the finger crank in its second position holds the remaining stock in both the first and second trays.

Other objects, features, and advantages of the invention will be apparent from the accompanying drawings and from the detailed description that follows below.

BRIEF DESCRIPTION OF THE DRAWINGS

The invention is illustrated by way of example and not limitation in the figures of the accompanying drawings, in which like references indicate similar elements and in which.

DETAILED DESCRIPTION

Figure 1:
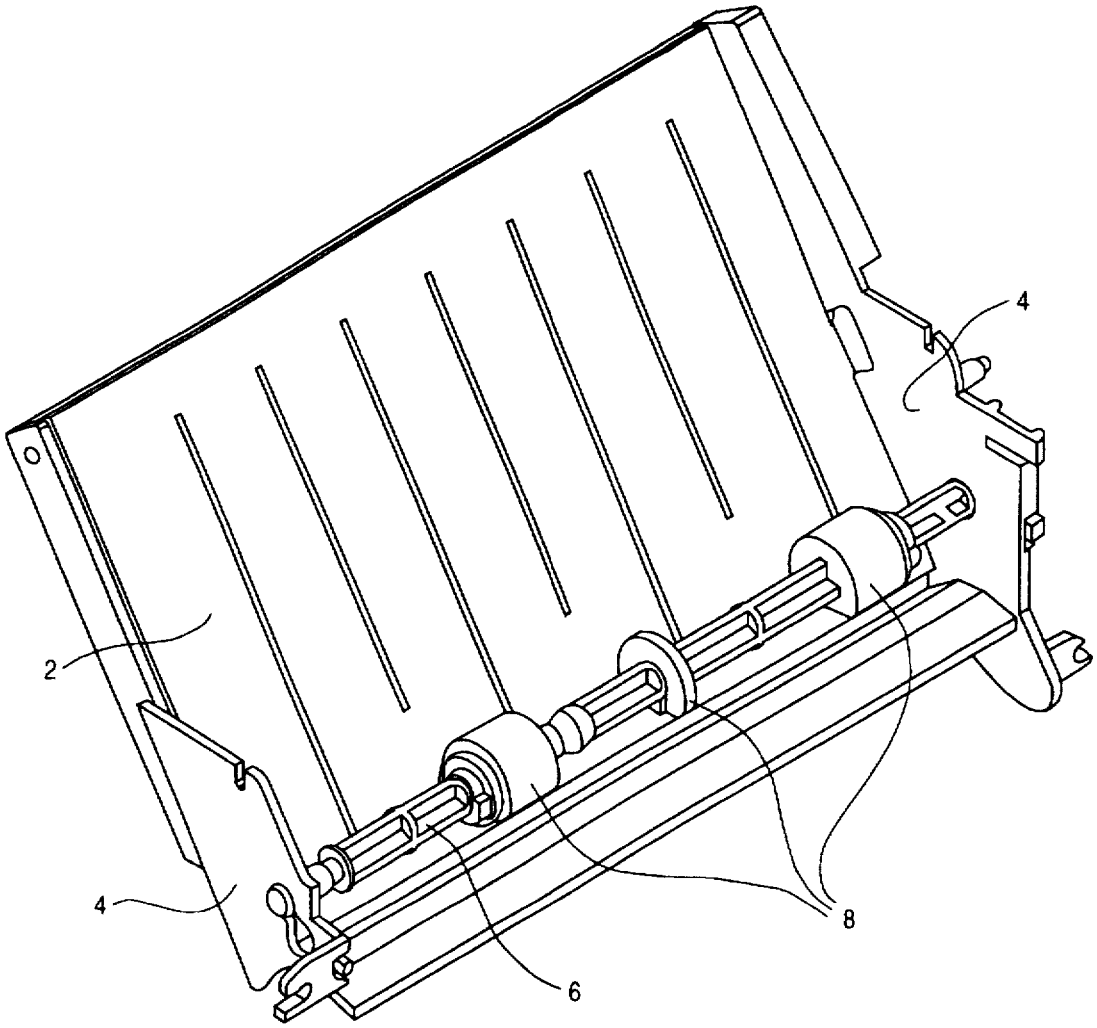
FIG 1 (PRIOR ART)
FIG. 1 is a front perspective view of the prior art roller driven tray printing device.

The invention incorporates multiple tray functionality into a roller driven tray information transfer device without the additional space or expense requirements associated with multi-tray transfer devices. The invention combines a first and second tray into a single apparatus. The apparatus utilizes a single roller to automatically move an item of feed stock from either the first or second tray. The single roller feeds a single feed port into the information transfer device from either tray without manual intervention. According to the invention, different feed stocks can be placed in the first and second trays. If the feed stock is in the second (forward) tray, the roller automatically chooses that stock and directs an item of feed stock from the second tray to the information transfer device. If the second tray is empty, the roller automatically chooses an item of feed stock from the first (back) tray and directs that item to the information transfer device. By providing an apparatus whereby all feed stock is moved by the same roller through a single feed port, the invention can incorporate the simplicity of single level sheet feeder into an information transfer device that offers multiple feed stock feeder functionality.

The invention contemplates uses on all information transfer devices, including scanning devices, facsimile devices, copying devices, and printing devices. In addition, the invention contemplates uses for multipurpose information transfer devices that combine any or all of scanning devices, facsimile devices, copying devices, and printing devices.

The invention also provides an apparatus for maintaining the alignment of feed stock in a roller driven tray information transfer device. The invention utilizes a cantilever finger crank to press against the unsupported corner of the remaining feed stock in a paper tray or against the unsupported corners of feed stock in both first and second trays to support the stock and keep the stock taut. The finger crank is actuated by a cam that is attached directly to the roller, so that when the roller rotates to retrieve an item of feed stock, the cam directs the cantilever finger crank to a first position to not impede the path of the selected item of feed stock into the information transfer device. After the selected item of feed stock is sent to the information transfer device, the cam directs the cantilever finger crank to a second position to hold the remaining stock in the paper tray, or in multiple paper trays, taut. The invention eliminates fanning and scew of the printable stock in the tray.

The invention contemplates the capacity to maintain the alignment of various forms of feed stock. Feed stock includes, but is not limited to, paper, paper derivatives, envelopes, cards, labels, transparencies, plastic, and plastic derivatives. Feed stock also includes documents containing an image wherein the documents are transported from the first or second tray into the information transfer device to process the image to an electronic image (scanning function), to a separate location over a voice frequency circuit (facsimile function), or to a reproduction with the aid of a printing device (copying function).

In one embodiment contemplated by the invention, the information transfer device is based on the design of the Apple Stylewriter series Inkjet printer that notably includes a head carriage to hold an Inkjet printing cartridge, a platen roller, and a motor to drive the head carriage and a motor to drive the platen roller and the tray roller. FIG. 1 presents a front perspective view of the prior art Apple Stylewriter printer series paper tray. FIG. 1 shows that the apparatus is comprised of a paper tray 2, a pair of side supports 4, a D-roller shaft 6 extending the width of the tray 2 and D-rollers 8 radially attached to the D-roller shaft 6.

Figure 2:
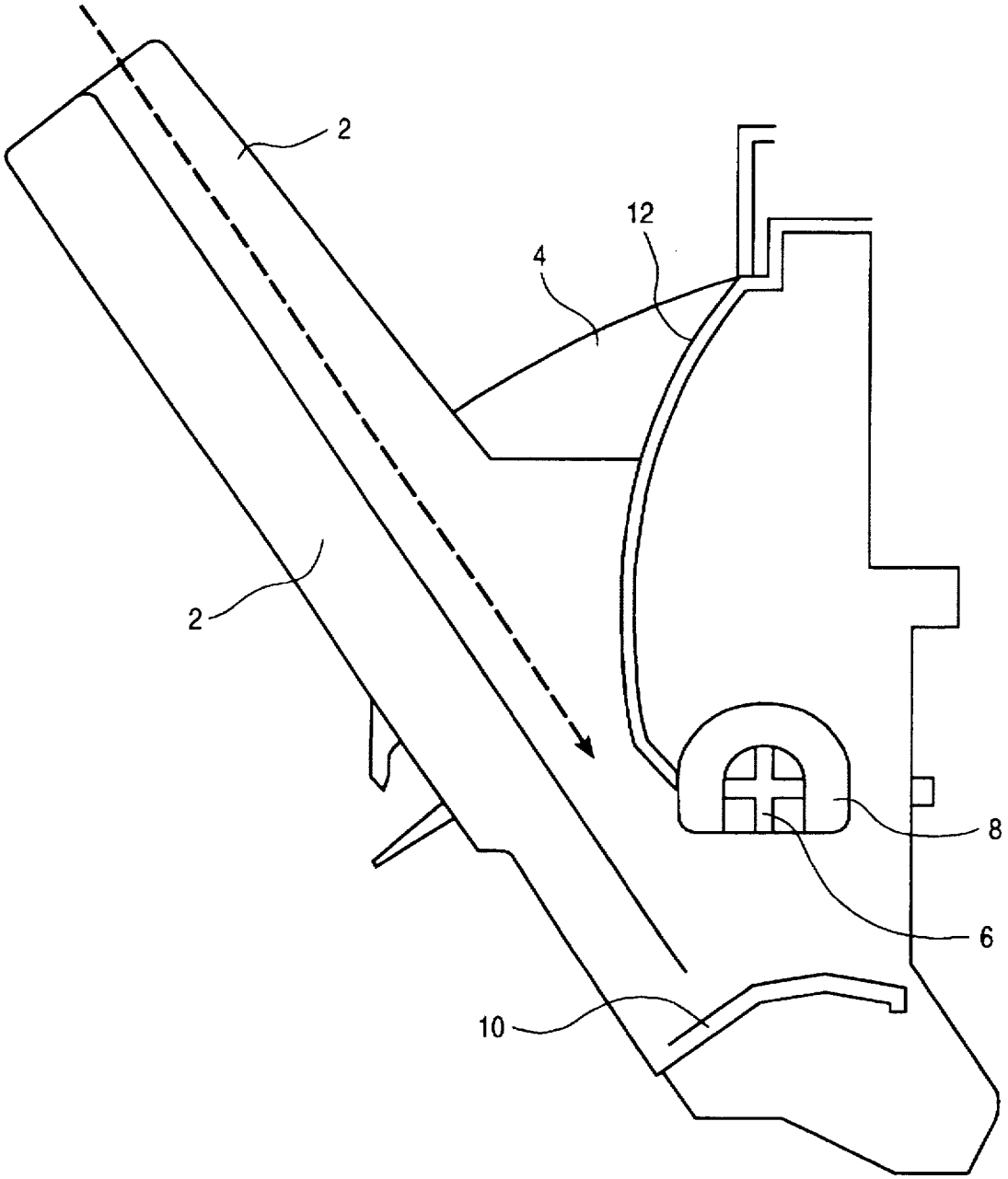
FIG 2 (PRIOR ART)
FIG. 2 is a side view of the prior art roller driven tray printing device.

FIG. 2 presents a side view of the prior art Apple Stylewriter printer series paper tray. FIG. 2 shows the D-roller 8 attached to the D-roller shaft 6. FIG. 2 also shows the platform or shelf 10 that the feed stock rests against. In addition to the tray 2 and the side supports 4, FIG. 2 further includes a director 12. The director 12 serves to define a space between the tray 2 and the director 12 for feed stock to be stored and to rest on the shelf 10 until such time as an item of feed stock (i.e., a sheet of paper) is selected by the D-roller 8 and moved through the device (the Apple Stylewriter printer).

The Apple Stylewriter printer series utilizes the apparatus shown in FIG. 1 and 2 wherein the apparatus is pivotally coupled to the printing device (not shown). Thus, when feed stock is to be retrieved from the paper tray 2, the paper tray 2 pivots slightly in a forward direction toward vertical. At the same time the D-roller 8 rotates on the D-roller shaft 6 and comes in contact with an item of feed stock in the space between the tray 2 and the director 12, e.g., a sheet of paper.

FIGS. 3–11 present an embodiment of the invention compatible with the Apple Stylewriter series Inkjet printing device. The depiction of the invention based on the Inkjet printing device is not meant to limit the invention to this printing mechanism. Instead, the invention contemplates usefulness with all information transfer devices, including multipurpose information transfer devices.

Figure 3:
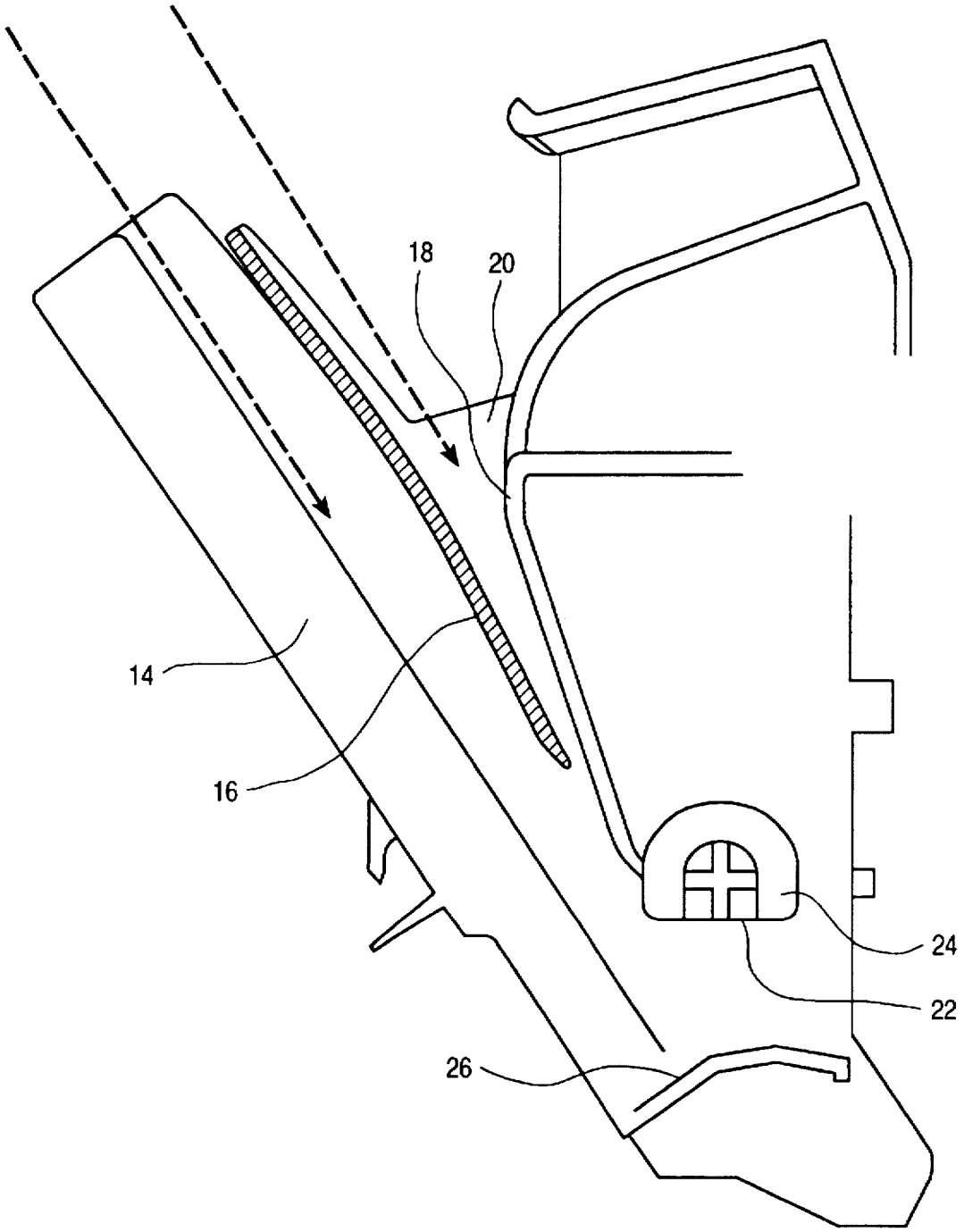
FIG. 3 is a side view of the apparatus of the invention.

FIG. 3 presents a side view of an embodiment of the invention. According to this embodiment, the apparatus includes a first tray 14 and a second tray 16, each tray coupled to a pair of side supports 20. The embodiment shows a first space between the first tray 14 and the second tray 16, the first space capable of storing feed stock. The apparatus of FIG. 3 also includes a director 18 that serves to define a second space between the second tray 16 and the director 18, the second space also capable of storing feed stock, notably more than a single item of feed stock. At the base of the apparatus of this embodiment is a shelf 26 to hold the feed stock resting in the first tray 14 and the second tray 16. The length of the second tray 16 does not extend to the shelf 26 extending from the first tray 14. In this embodiment, the director 18 directs feed stock in the second space toward the first space. FIG. 3 also shows a side view of a roller (a D-roller) 24 attached to the D-roller shaft 22. According to the embodiment shown, an item of feed stock (i.e., paper, envelope, etc.) in the first tray 14 (i.e., the first space) or the second tray 16 (i.e., the second space) is caught by the rotation of a single revolution of the D-roller 24 and transported into the information transfer device (not shown). If items of feed stock are in both the first and second spaces, the D-roller 24 will automatically choose the item of feed stock in the second space since that item will be in front of the item in the first space.

Figure 4:
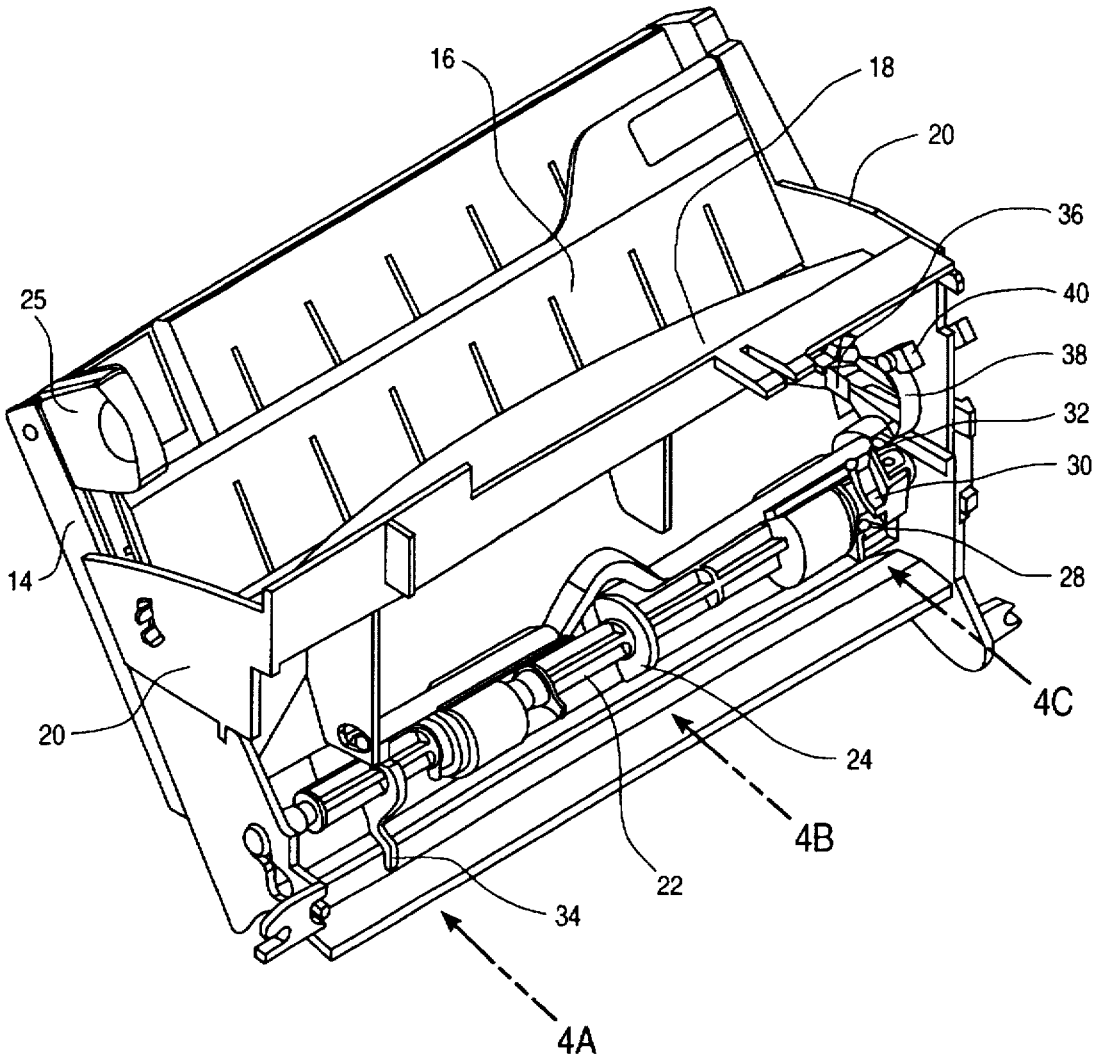
FIG. 4 is a front perspective view of the apparatus of the invention.

FIG. 4 shows an embodiment of the invention with two trays and an apparatus for maintaining the alignment of feed stock in the trays. According to this embodiment, the invention includes a first tray 14 and a second tray 16, each tray coupled to a pair of side supports 20. The embodiment shows a first space between the first tray 14 and the second tray 16, the first space capable of holding more than one item of feed stock. The apparatus of FIG. 4 also includes a director 18 that serves to define a second space between the second tray 16 and the director 18, the second space similarly capable of holding more than one item of feed stock. The embodiment also includes an adjustable guide 25 slidably coupled to the front of the first tray 14 that allows feed stock of various widths to be secured snugly in the first tray 14.

The embodiment of FIG. 4 also displays the D-roller shaft 22 attached at its ends to the side supports 20. A D-roller 24 is radially attached at the center of the D-roller shaft 22 to transport an item of feed stock into the information transfer device (not shown). In FIG. 4, the D-roller 24 is facing away from the first and second trays and could contact an item of feed stock only by rotating 180° on the D-roller shaft 22.

The embodiment of FIG. 4 also illustrates the apparatus for maintaining alignment of feed stock in the first tray 14 and the second tray 16. In this embodiment, a cam 28 is radially coupled to the end of the D-roller shaft 22. A cam follower 30 is seated on the cam 28 and coupled to a cam shaft 32. The cam shaft extends parallel to and above the D-roller shaft 22 and D-roller 24 and is slidably coupled to the director 18. A cantilever finger crank 34 is rotably coupled to the cam shaft 32 and rests radially on the D-roller shaft 22. The finger crank 34 extends vertically into the path of items of feed stock from the first tray 14 and the second tray 16 into the information transfer device (not shown). As the cam 28 rotates about the D-roller shaft 22, the cam follower 32 actuates the cam shaft 32 to slide forward or backwards in its coupling. As the cam shaft 32 is actuated forward or backward, the cantilever finger crank 34 moves into or out of the path of the feed stock into the information transfer device (not shown). In FIG. 4, the cantilever finger crank 34 is in a position to be in the path of feed stock and to exert a force against feed stock in either the first tray 14 or the second tray 16.

FIG. 4 also demonstrates an embodiment of the invention wherein a sensor detects feed stock in the second tray 16. According to this embodiment, a sensor (not shown) extends into the path of the second tray 16 to sense feed stock in the second tray 16. The sensor is connected to a fulcrum 36 that actuates a sensor flag 38 to trigger an opto-electrical switch 40. A sensing device as described is particularly useful wherein the processing function of the printing mechanism feeds an information transfer device capable of accomplishing different functions. For example, an embodiment of the invention includes the apparatus of FIG. 4 being coupled to and feeding an information transfer device capable of accomplishing the multiple functions of printing, scanning, sending and receiving facsimiles, and copying. The sensing device is utilized to trigger the information transfer device, by way of the opto-electrical switch to scan the feed stock in the second tray and either process the image on an item of feed stock to an electronic image (scanning function), to a separate location over a voice frequency circuit (facsimile function), or to a reproduction with the aid of an associated printing mechanism (copying function). The invention further contemplates that the paper to produce the copy of the processed image is retrieved from the first tray.

Figure 5:
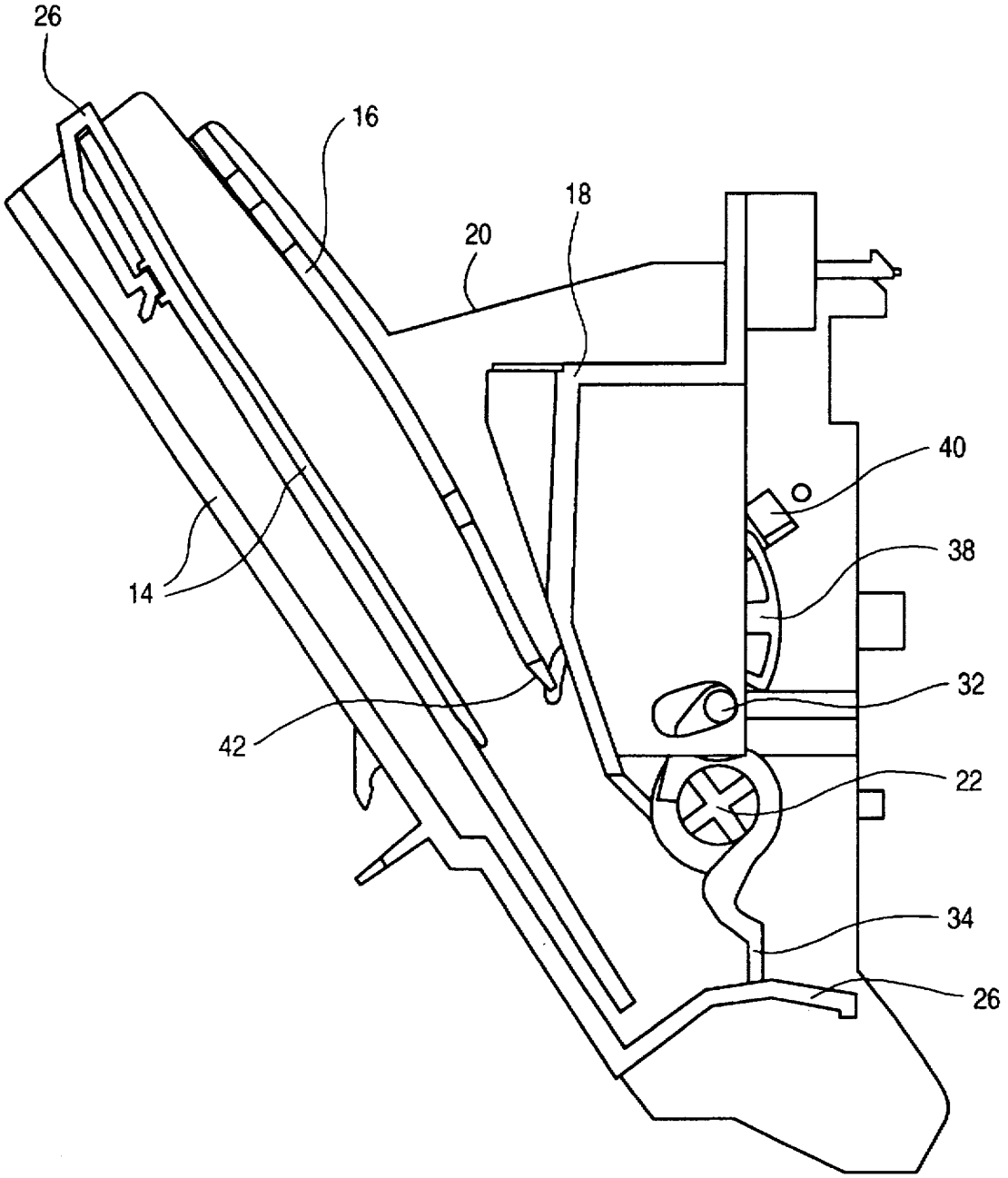
FIG. 5 is a side view of the apparatus of the invention through line 4A.

FIG. 5 represents a side view of an embodiment of the invention taken through line 4A of FIG. 4. FIG. 5 clearly shows the cantilever finger crank 34 coupled to the cam shaft 32, radially rested on the D-roller shaft 22, and extended into the path of the feed stock from the first tray 14 or the second tray 16. FIG. 5 also displays the shelf 26 upon which the feed stock in the first tray 14 or the second tray 16 rests before being transferred into the information transfer device.

FIG. 5 further presents the sensor of the sensing device that alerts the information transfer device, by way of a signal from the opto-electrical switch 40, that feed stock is in the second tray 16. In this case, the sensor is a finger 42 that is connected to a fulcrum (not shown) and has a first position across the second space defined by the second tray 16 and the paper director 18 and a second depressed position when feed stock is in the second space. As shown in FIG. 5, the finger 42 is in the first position.

Figure 6:
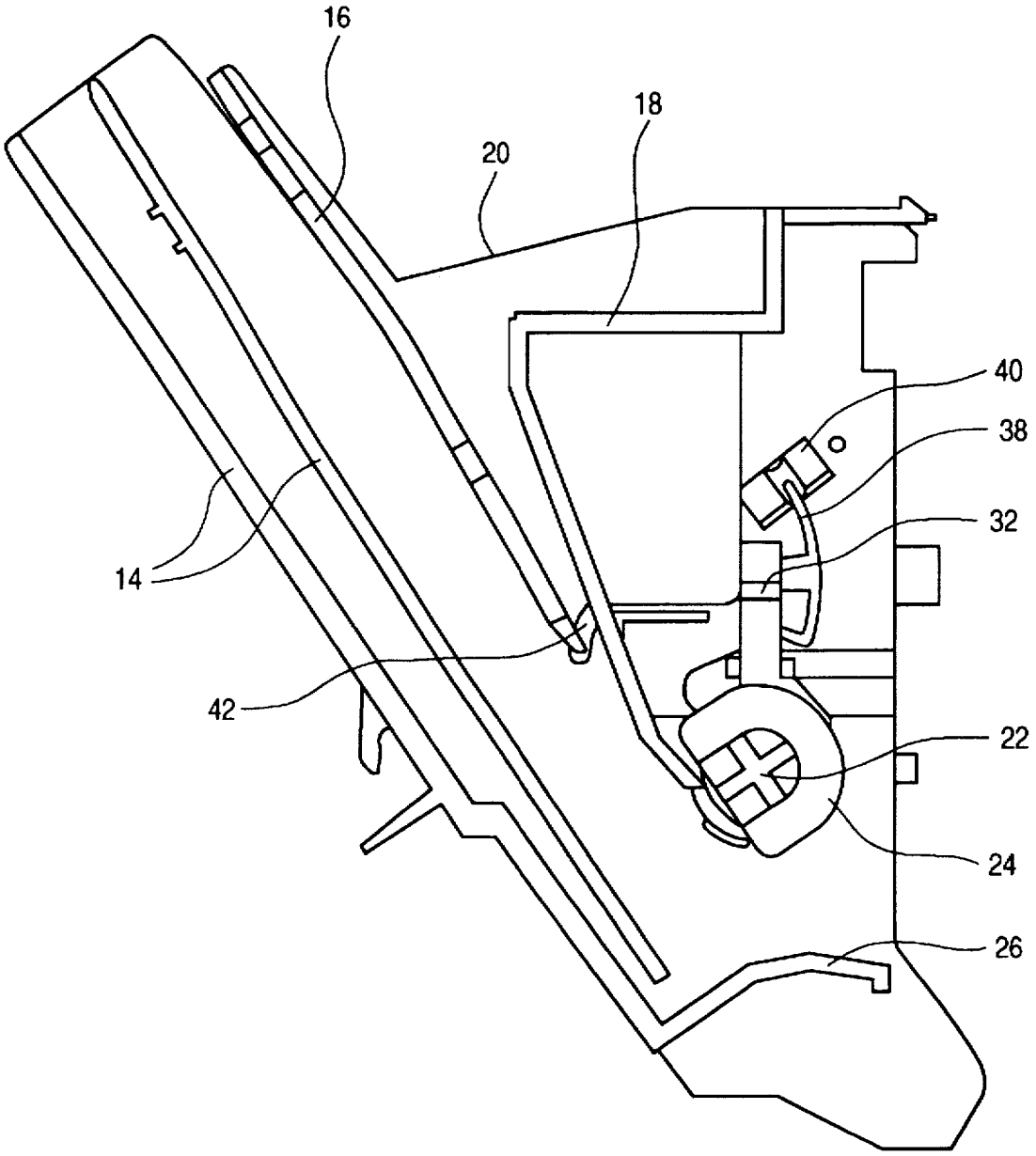
FIG. 6 is a side view of the apparatus of the invention through line 4B.

FIG. 6 illustrates a side view of an embodiment of the invention taken through line 4B of FIG. 4. FIG. 6 shows the cam shaft 32 above the D-roller 24 and parallel to the D-roller shaft 22. FIG. 6 also shows the first space between the first tray 14 and the second tray 16, the second space between the second tray 16 and the paper director 18, the finger 42 of the sensing device extending across the second space, and the sensor flag 38 and the opto-electrical switch 40 associated with the sensing device.

Figure 7:
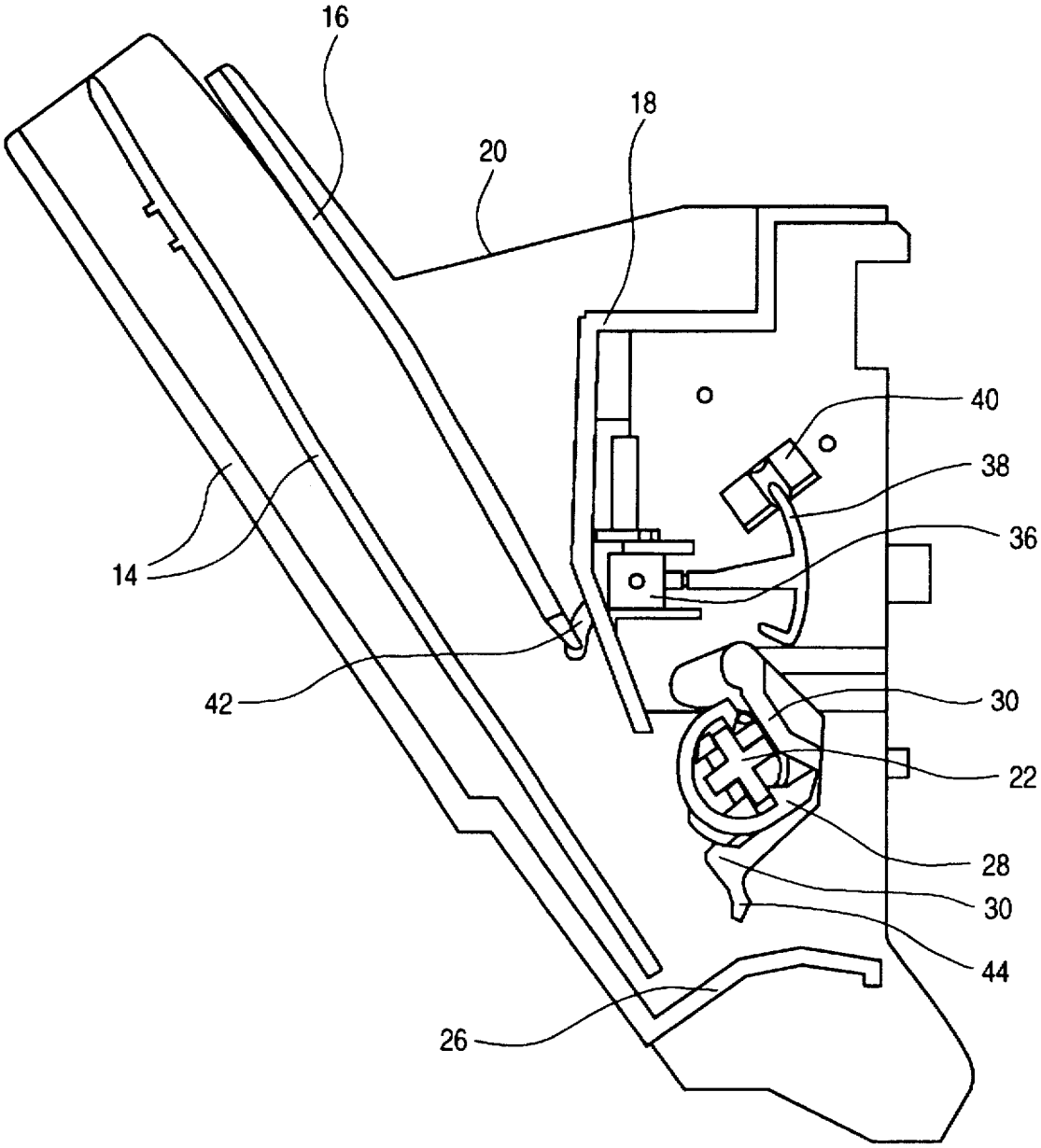
FIG. 7 is a side view of the apparatus of the invention through line 4C.

FIG. 7 presents a side view of an embodiment of the invention taken through line 4C of FIG. 4. FIG. 7 shows the cam 28 radially coupled to the D-roller shaft 22 and a cam follower 30 resting on the cam 28. The cam follower also comprises a stopper 44 to push against feed stock in the other corner of the tray apparatus.

FIG. 7 also shows a complete view of the sensing device. A finger 42 is pivotally connected to a fulcrum 36 and extends into the second space between the second tray 16 and the director 18. On the opposite side of the fulcrum 36 is a sensor flag 38 having a first position and a second position. At the second position of the sensor flag 38 is an opto-electrical switch that, when triggered by the sensor flag 38, alerts the information transfer device that feed stock is in the second space.

Figure 8:
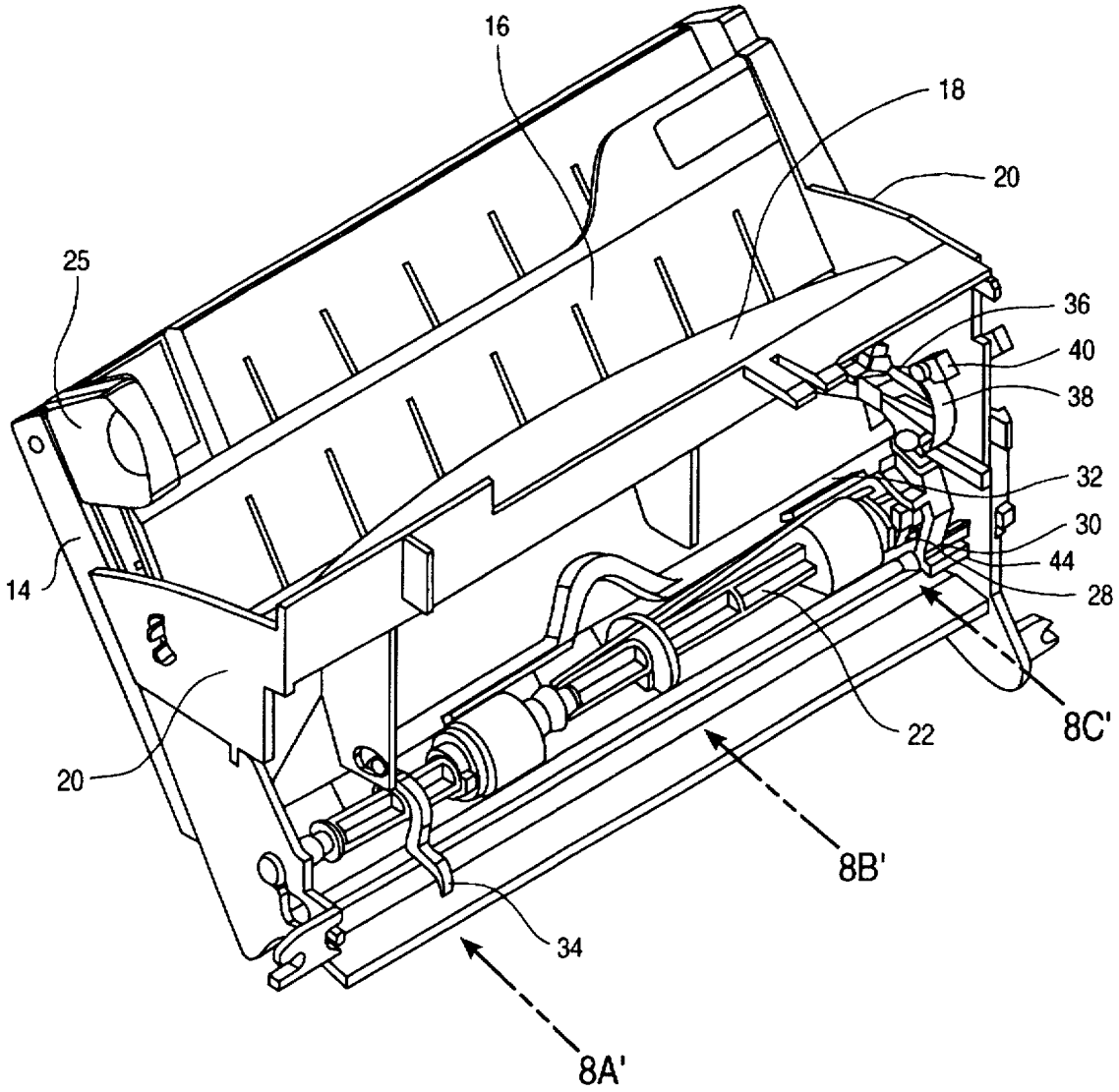
FIG. 8 is a front perspective view of the apparatus of the invention with the finger crank in a position to not impede the path of the selected sheet of printable stock into the information transfer device.

FIG. 8 demonstrates an embodiment of the invention with two trays and an apparatus for maintaining the alignment of the feed stock in the trays. In contrast to FIG. 4, FIG. 8 shows the apparatus with no impediments in the path of either the first tray 14 or the second tray 16 into the information transfer device. In FIG. 8, the D-roller 24 has begun a revolution wherein it will come in contact with an item of feed stock, from either the first space of the first tray or the second space of the second tray, and transport the item of feed stock into the information transfer device. FIG. 8 also shows that the cam 28 has moved the cam follower 30, that, in turn, moves the stopper 44 out of the path of the feed stock. Similarly, the cam shaft 32 attached to the cam follower 30 has moved the cantilever finger crank 34 out of the path of the feed stock from the first tray 14 and the second tray 16. According to FIG. 8, there is nothing pressing against the base of the feed stock in either tray.

Figure 9:
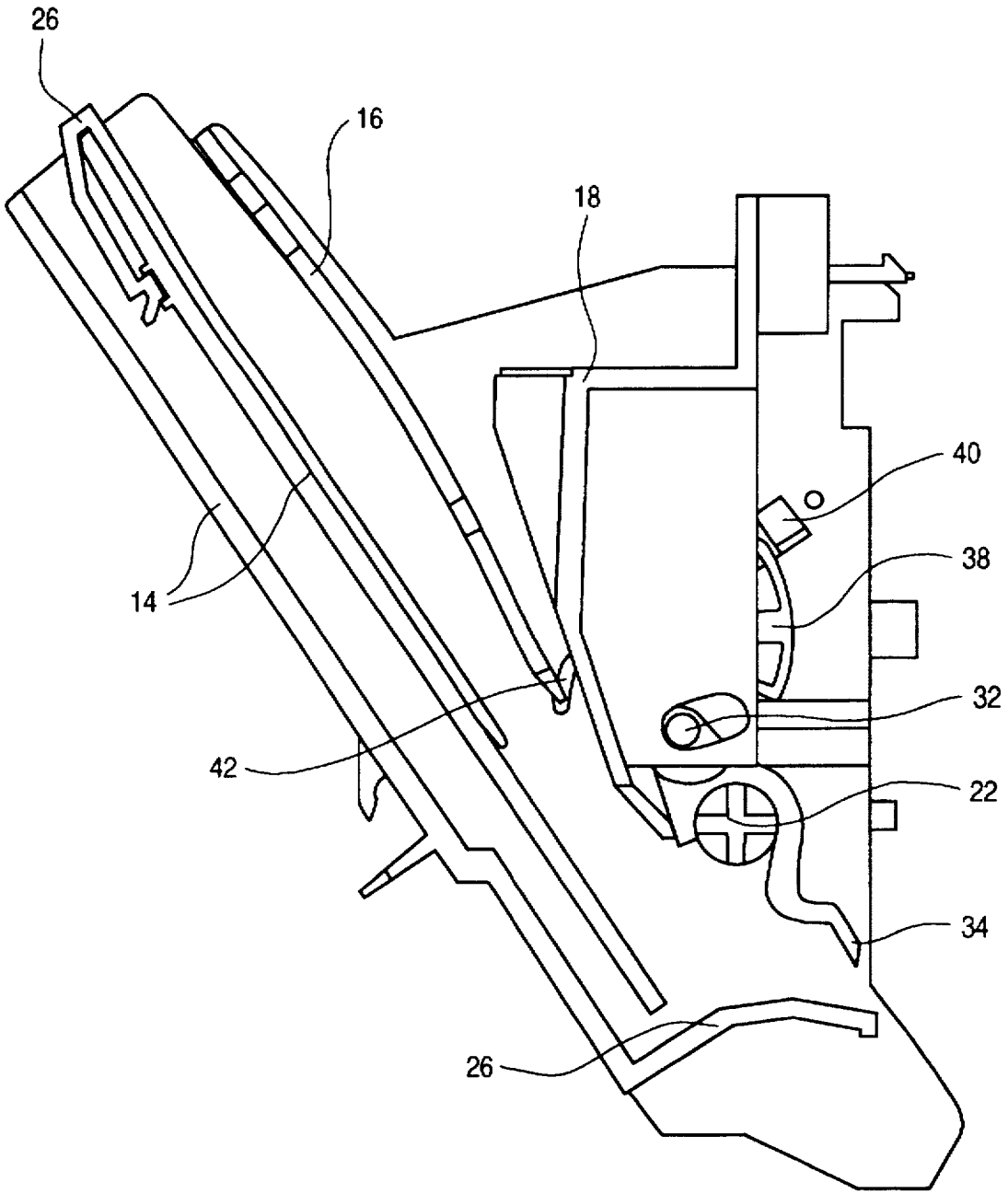
FIG. 9 is a side view of the apparatus of the invention through line 8A'.

FIG. 9 illustrates a side view of an embodiment of the invention taken through line 8A'. From this view, it is demonstrated that the cantilever finger crank 34 has been moved by the cam shaft 32 away from the feed stock in either the first tray 14 or the second tray 16.

Figure 10:
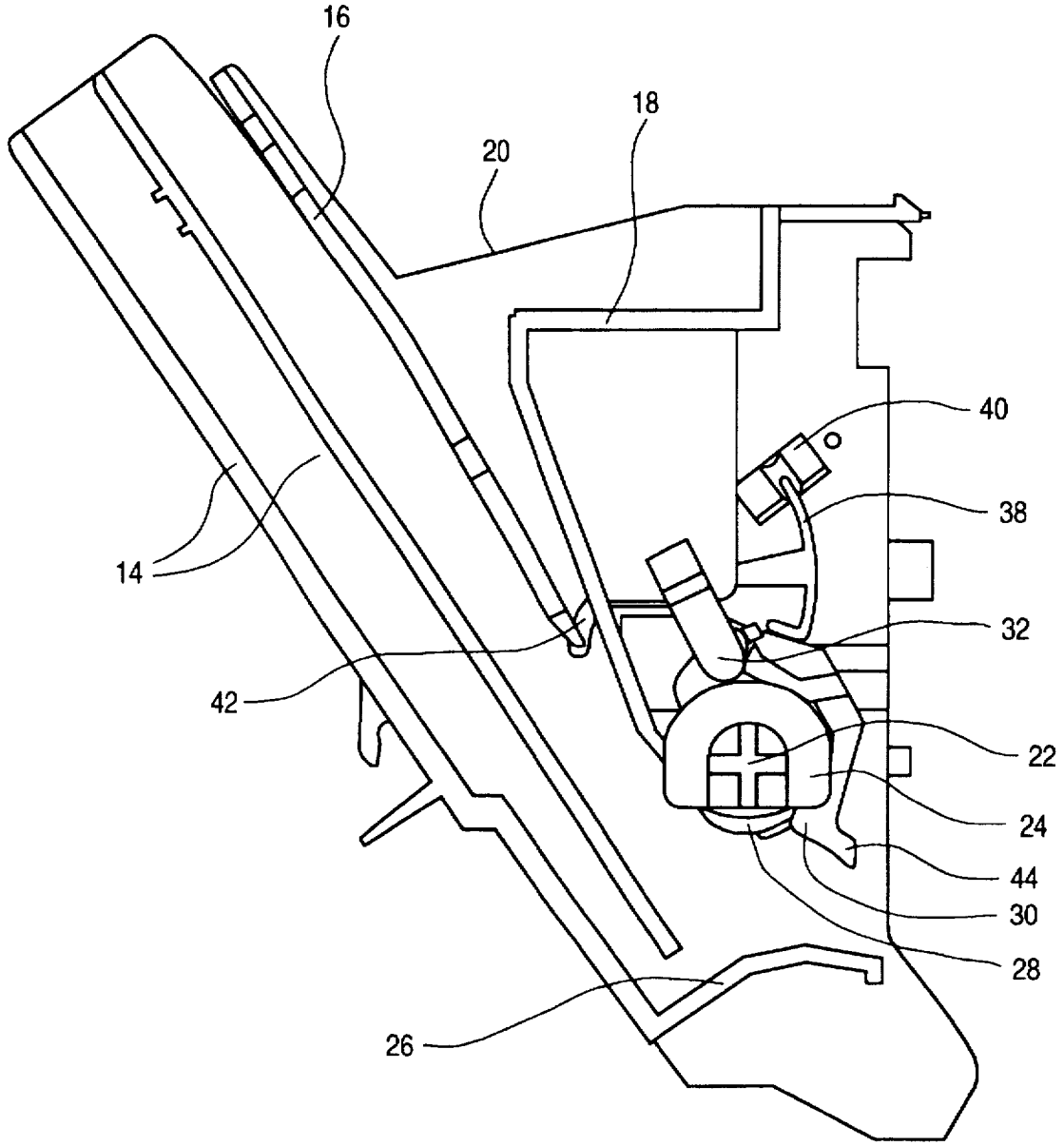
FIG. 10 is a side view of the apparatus of the invention through line 8B'.

FIG. 10 illustrates a side view of an embodiment of the invention taken through line BB'. FIG. 10 shows the cam 28 having moved the cam follower 30 and the stopper 44 out of the way of the feed path from the first tray and the second tray. FIG. 10 also shows the location of the cam shaft 32 as it appears having been moved by the cam follower 30.

Figure 11:
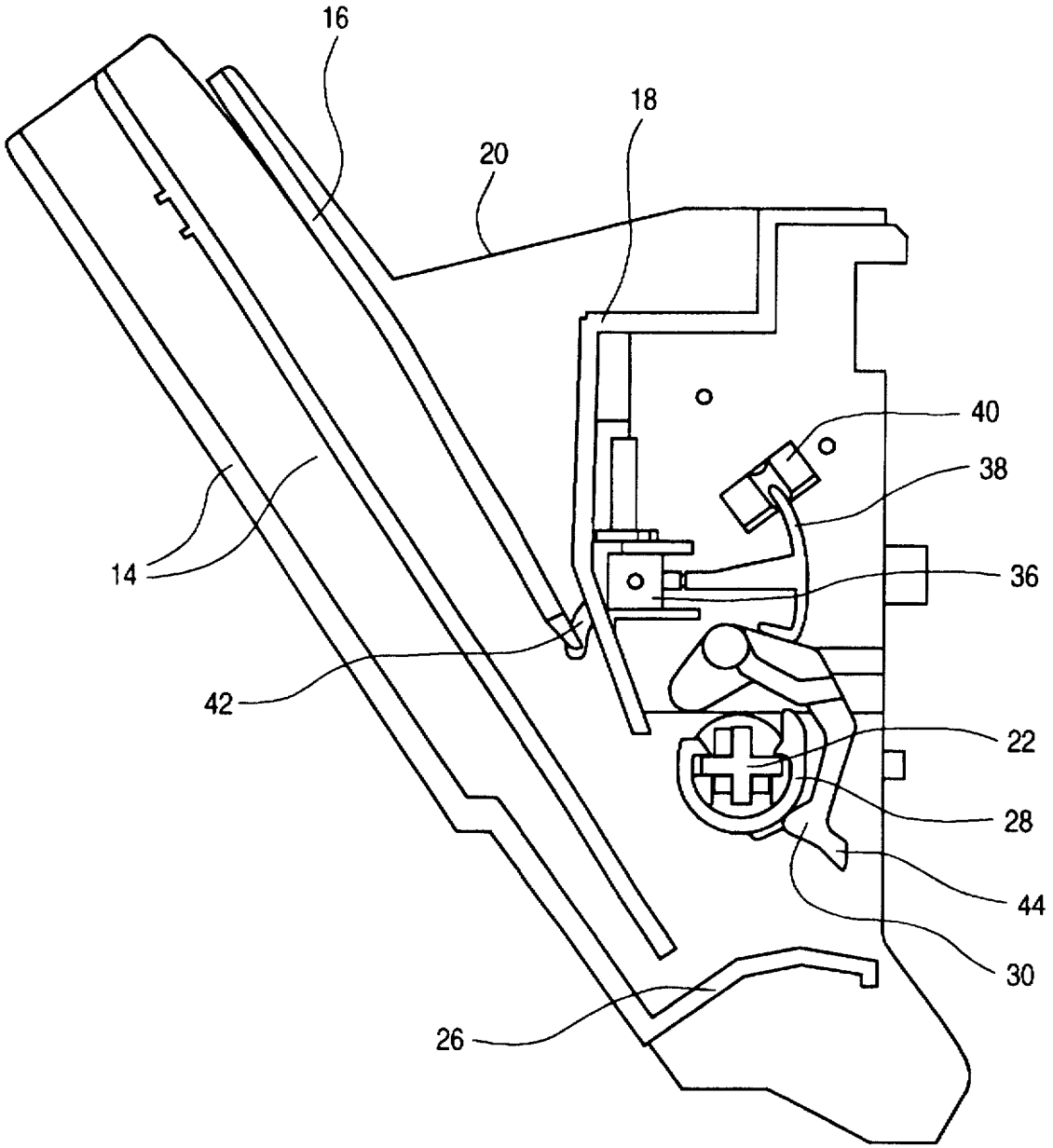
FIG. 11 is a side view of the apparatus of the invention through line 8C'.

FIG. 11 shows a side view of an embodiment of the invention taken through line 8C'. FIG. 11 shows the cam 28, the cam follower 30, and the stopper 44 in a position to not impede the path of feed stock from the first tray 14 or the second tray 16.

FIGS. 3–11 demonstrate an embodiment of the invention wherein feed stock in the second space between the second tray and the paper director will be selected over feed stock in the first space between the first and second trays. According to this embodiment, feed stock in the first space will only be transferred by the D-roller to the information transfer device when there is no feed stock in the second space.

FIG. 3–11 also demonstrate an embodiment of the invention that may be used with any information transfer device, including multipurpose information transfer devices. The invention contemplates use with scanning devices, facsimile devices, copying devices, and printing devices and any combination of some or all of these machines.

FIGS. 3–11 presented an embodiment of the invention whereby the tray apparatus is slidably coupled to the information transfer device. In this embodiment, the first and second trays automatically tilt slightly forward toward vertical when an item of feed stock is to be sent to the information transfer device. One method of coordinating the tilting of the tray apparatus and the rotation of the D-roller utilizes a gear chain engaged to a single motor wherein the gear chain tilts the tray apparatus and also rotates the D-roller. An item of feed stock in either the first tray or the second tray can come in contact with the roller (in this case a D-roller) as the roller rotates about its axis. The invention is not limited to an apparatus that must tilt forward to bring the item of food stock in contact with the roller. The invention also contemplates an apparatus wherein the roller may come in contact with feed stock without the movement of the tray apparatus.

In the preceding detailed description, the invention is described with reference to specific exemplary embodiments thereof. It will, however, be evident that various modifications and changes may be made thereto without departing from the broader spirit and scope of the invention as set forth in the claims. The specification and drawings are, accordingly, to be regarded in an illustrative rather than a restrictive sense.

What is claimed is:

1. An apparatus for maintaining alignment of feed stock in a roller driven tray device comprising:

a tray housing with a motor and at least one paper tray to hold an item of feed stock for processing in an information transfer device;

a roller shaft having a first end and a second end and extending substantially the width of the tray housing;

a cam radially coupled to the first end of the roller shaft;

a cam follower with a first end and a second end, wherein the second end is seated on the cam, such that the cam follower will move to one of a first position and a second position in response to the movement of the cam;

a cam shaft having a first end and a second end and extending in a direction substantially parallel to the roller shaft, wherein the first end is coupled to the second end of the cam follower and the second end is slidably coupled to the tray housing; and a cantilever finger crank with a first end and a second end and extending in a direction substantially perpendicular to the roller shaft, wherein the first end is coupled to the cam shaft, and the second end has a first position to not impede the path of the feed stock and a second position against the feed stock.

2. The apparatus of claim 1, wherein the cam shaft extends substantially the width of the tray.

3. The apparatus of claim 1, wherein the first end of the finger crank is coupled substantially to the second end of the cam shaft.

4. The apparatus of claim 1, wherein the feed stock is comprised of paper, paper derivatives, envelopes, cards, labels, plastic, plastic derivatives, transparencies, and documents containing an image.

5. The apparatus of claim 1, wherein the second end of the cam follower includes a stopper wherein the stopper has a first position to not impede the path of the feed stock and a second position against the feed stock, and wherein the first position of the stopper corresponds to the first position of the finger crank, and the second position of the stopper corresponds to the second position of the finger crank.

6. The apparatus of claim 1, wherein the apparatus is coupled to an information transfer device and the feed stock is fed into the information transfer device.

7. The apparatus of claim 6, wherein the information device is comprised of a printing device, a scanning device, a facsimile device, or a copying device.

8. The apparatus of claim 6, wherein the information device is comprised of a combination of a printer, a scanner, a facsimile machine, and a copier.

9. An apparatus for feeding distinct feed stock through an information transfer device comprising:

an information transfer device for processing feed stock, the information transfer device including a motor;

a first tray with a front portion and a rear portion and a base, wherein the first tray is coupled to the information transfer device;

at least two side supports with length portions, each side support coupled to either end of the first tray;

a second tray with a front portion and a rear portion and a length that does not extend to the base of the first tray, coupled at either side to the pair of side supports to define a first space between the front portion of the first tray and the rear portion of the second tray, wherein the first space is capable of holding at least one item of feed stock for processing through the information transfer device, and a second space between the front portion of the second tray and the length of the side supports, wherein the second space is capable of holding at least one item of feed stock for processing through the information transfer device;

a roller shaft with a first end and a second end, the first end and the second end rotatably coupled to the pair of side supports, and wherein the roller shaft is engaged to the motor; a roller radially coupled to the roller shaft to retrieve feed stock from the first space or the second space; and a sensory device actuatably extended across a portion of the width of the second space.

10. The apparatus of claim 9, wherein the information transfer device is comprised of a printer, a scanner, a facsimile machine, or a copier.

11. The apparatus of claim 9, wherein the information transfer device is comprised of a combination of a printer, a scanner, a facsimile machine, and a copier.

12. The apparatus of claim 9, wherein the apparatus has a first position wherein feed stock in the apparatus is not in contact with the roller and a second position wherein feed stock in the apparatus is in contact with the roller.

13. The apparatus of claim 9, wherein the roller is a D-roller.

14. The apparatus of claim 9, wherein a director is coupled to the side supports to define the second space between the front of the second tray and the director and to join the second space with the first space at the base of the first tray.

15. The apparatus of claim 9, wherein the sensing device comprises:

a fulcrum;

a finger having a first end and a second end wherein the first end is pivotally connected to the fulcrum and the second end extends substantially across the width of the second space, the finger further having a first position and a second position and wherein the finger is predisposed to the first position;

a sensor flag pivotally connected to the fulcrum, the sensor flag having a first position and a second position; and an opto-electrical switch at the second position of the sensor flag.

16. The apparatus of claim 9, further comprising an apparatus for maintaining alignment of feed stock in the first and second trays comprising:

a cam radially coupled to the first end of the D-roller shaft;

a cam follower with a first end and a second end, wherein the second end is seated on the cam, such that the cam follower will move to one of a first position and a second position in response to the movement of the cam;

a cam shaft having a first end and a second end, and extending in a direction substantially parallel to the roller shaft wherein the first end is coupled to the second end of the cam follower and the second end is slidably coupled to a side support; and a cantilever finger crank with a first end and a second end, and extending in a direction substantially parallel to the roller shaft wherein the first end is coupled to the cam shaft, and the second end and extending in a direction substantially perpendicular to the roller shaft of the cantilever finger crank has a first position to not impede the path of the feed stock and a second position against the feed stock in the first and second trays.

17. The apparatus of claim 16, wherein the cam shaft is slidably coupled to the paper director.

18. The apparatus of claim 17 wherein the first end of the finger crank is coupled substantially to the second end of the cam shaft.

19. The apparatus of claim 9, wherein the feed stock is comprised of paper, paper derivatives, envelopes, cards, labels, transparencies, plastic, plastic derivatives, and documents containing an image.

* * * * *